United States Patent [19]

Yanase

[11] Patent Number: 4,702,718

[45] Date of Patent: Oct. 27, 1987

[54] CONTROLLED-DRIVE TOY

[75] Inventor: Tsunao Yanase, Fukuoka, Japan

[73] Assignee: Kaho Musen Limited, Japan

[21] Appl. No.: 827,101

[22] Filed: Feb. 5, 1986

[51] Int. Cl.[4] ..... A63H 17/395

[52] U.S. Cl. ..... 446/175; 446/436; 56/DIG. 15; 180/6.5

[58] Field of Search ..... 446/175, 436; 180/6.5, 180/169, 79.1, 167; 56/10.2, DIG. 15; 250/570, 202

[56] References Cited

U.S. PATENT DOCUMENTS 2,775,848 1/1957 Isaacson ..... 446/436

3,061,035 10/1962 King ..... 180/79.1

3,130,803 4/1964 Wiggins ..... 180/6.5 X 3,789,939 2/1974 Geislinger ..... 180/6.5

*Primary Examiner*—Mickey Yu

*Attorney, Agent, or Firm*—Leydig, Voit & Mayer

[57] ABSTRACT

A controlled-drive toy including two driving wheels independently driven by driving motors controlled by data carried by a rotary disc. The rotary disc carries white and black data segments forming a pair of data rings to represent a moving pattern for the toy. Photosensors are provided to detect reflections from the white and black segments and to produce signals to energize the driving motors. The rotary disc can be easily replaced so that a different moving pattern can be provided.

2 Claims, 7 Drawing Figures

CONTROLLED-DRIVE TOY

TECHNICAL FIELD

This invention relates to a controlled-drive toy and, more particularly, to a toy driven by a pair of driving wheels and having a supporting wheel.

BACKGROUND ART

In a conventional three-wheeled toy, a pair of driving wheels are driven by a drive unit energized by a power supply so as to move forward and backward. For obtaining left and right movement or for obtaining a pattern of movement in all directions, the toy must be physically turned in the desired directions.

DISCLOSURE OF INVENTION

It is, therefore, an object of the present invention to eliminate the above-noted insufficiency by providing an improved three-wheeled toy having two of the three wheels independently driven by a driving unit in accordance with a pre-selected pattern.

A further object of the present invention is to provide a controlled-drive toy in which the preselected pattern can be easily changed so that the toy can be automatically moved in a different pattern.

BRIEF DESCRIPTION OF DRAWINGS

The above and further objects and novel features of the present invention will become more apparent from the following detailed description, taken in connection with the drawings, in which.

BEST MODE FOR CARRYING OUT THE INVENTION

Figure 1:
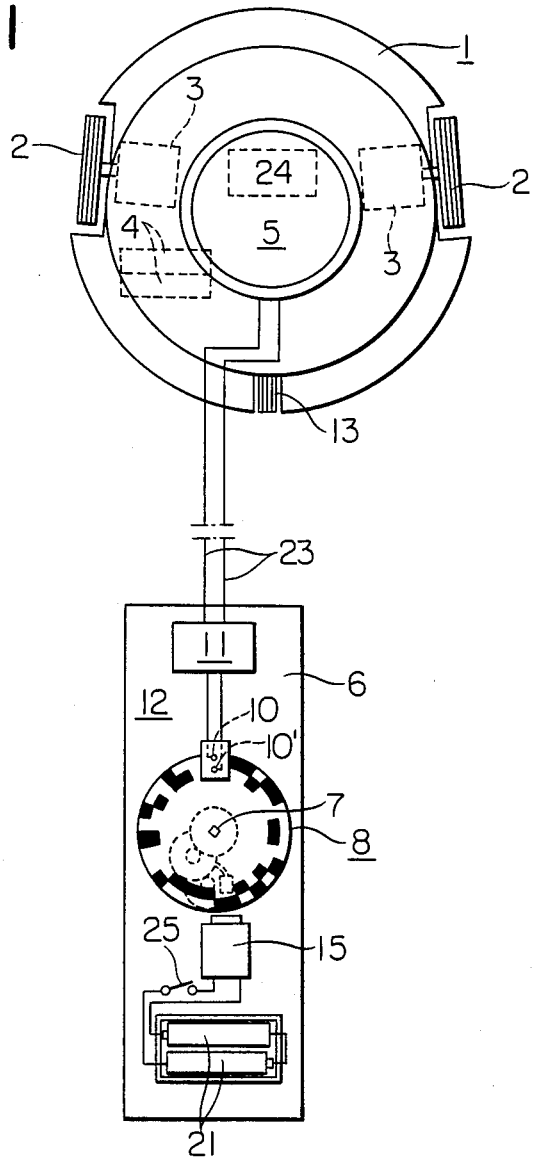
FIG. 1 is a schematic view of a controlled-drive toy of the present invention.
Figure 2:
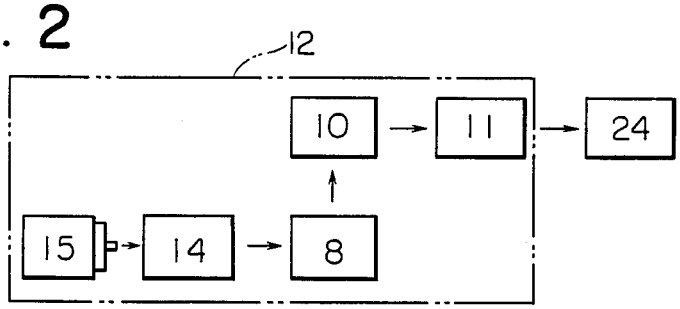
FIG. 2 is a block circuit diagram for said controlled-drive toy.

Referring now to FIGS. 1–5, which illustrate schematically a preferred embodiment of the invention, a body member 1 of a toy has a pair of driving wheels 2 and 2' rotatably mounted thereon. A pair of driving motors 3 and 3' mounted on the body member 1 are connected to independently drive respective driving wheels 2 and 2'.

A battery 4 supplies necessary power for the motors 3 and 3' and, combined with the body member 1, the pair of driving wheels 2 and 2', the pair of driving motors 3 and 3', and a supporting member 13 rotatably mounted to said body member 1, provide a running car 5.

A supporting plate 6 is preferably mounted on the body member 1 and has a rotary shaft 7 for supporting a rotary disc 8. The rotary disc 8 is removable from the rotary shaft 7 and includes a pair of data rings 9 and 9', each having white and black segments 17 and 18 which represent a preselected moving pattern of the toy.

Photosensors 10 and 10' are provided for reading and detecting the white and black segments 17 and 18 as the rotary disc is rotated. Depending upon the relative location and duration of these white and black segments

17 and 18, the photosensors 10 and 10' produce signals representing the pre-selected moving pattern of the toy. These signals are sent to a switching circuit 11 and in turn to a driving unit 24 via connecting cables 23 for controlling the drive motors 3 and 3'. The rotary disc is rotated by a driving motor 15 connected to a battery 21 via a switch 25 and a speed reduction gear mechanism 14. These components are combined to form a control unit 12, shown in FIGS. 1–3.

Figure 3:
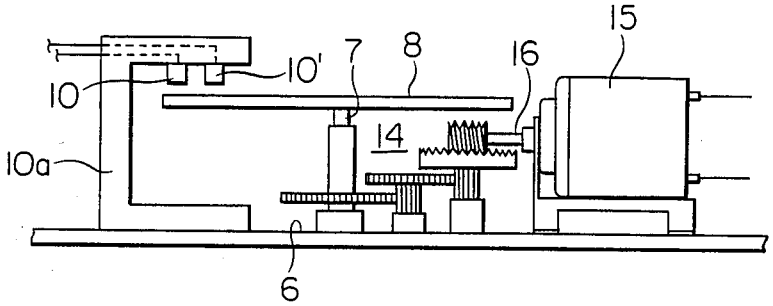
FIG. 3 shows a side view of a control unit.

In particular, FIG. 3 shows in detail the mechanical construction of the control unit 12 in which the speed reduction gear mechanism 14 is connected to an output shaft 16 of the control driving motor 15 and the rotary disc 8 via the rotary shaft 7.

Figure 4:
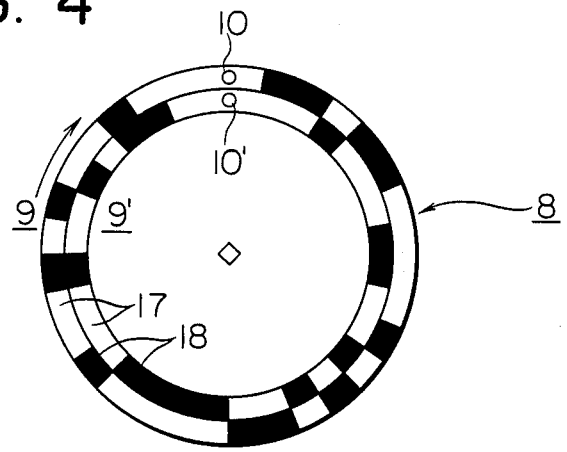
FIG. 4 shows a part of said control unit.

FIG. 4 shows the rotary disc including the pair of data rings 9 and 9' with the white and black segments 17 and 18. The photosensors 10 and 10' are located above the white and black segments to detect ultrared reflections emitted by these segments and to produce signals representing the pre-selected encoded moving pattern of the toy.

Figure 5:
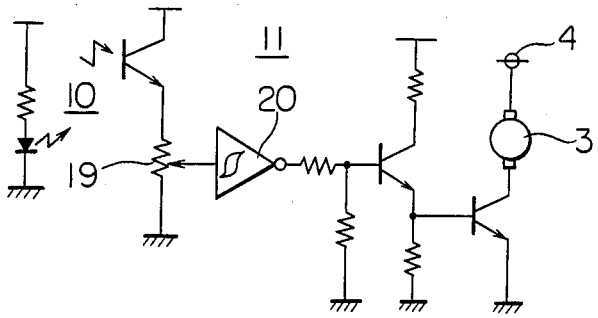
FIG. 5 shows a circuit diagram of a control unit.

FIG. 5 illustrates a detecting portion of the switching circuit 11 utilizing the photosensor 10 to detect a difference of reflection rate of white and black segments 17 and 18. A similar detecting circuit can be employed with the photosensor 10'. It is noted that sensitivity adjustment is controlled by a semi-variable resistor 19 applied to an inverter 20 of a Schmidt trigger circuit so as to obtain a width of threshold to prevent interference by ambient light.

As the rotary disc 8 is rotated, the white and black segments 17 and 18 are detected to turn the driving motor 3 on and off by the conduction and nonconduction of transistor 24. Therefore, by providing varying length white and black segments 17 and 18 on the data rings 9 and 9' of said rotary disc 8 and by rotating the rotary disc 8 on said rotary shaft 7, the switching circuit 11 is caused to open when a white segment 17 is detected and close when a black segment 18 is detected so as to turn the driving motor 3 on and off, respectively. Furthermore, by providing the white and black segments 17 and 18 at different locations and durations on the data rings 9 and 9', the driving motors 3 and 3' are respectively driven to move the toy in different directions determined by the combined rotation of the drive wheels, that is, when the left drive wheel 2 (as shown in FIG. 1) is rotated for a longer duration than the right drive wheel 2', the toy moves to the right. When the right drive wheel 2' is rotated for a longer duration than that the left drive wheel 2, the toy moves to the left. When the drive wheels are simultaneously rotated for the same duration, the toy moves straight forward or backward, depending on the clockwise or counterclockwise rotation of the drive wheels 2 and 2'. Therefore, by selecting various white and black segments on the data rings, the user can direct the toy in a desired pattern of movement and by replacing the rotary disc with one having data segments at different locations and for different durations, a different moving pattern is provided for the toy.

Figure 6:
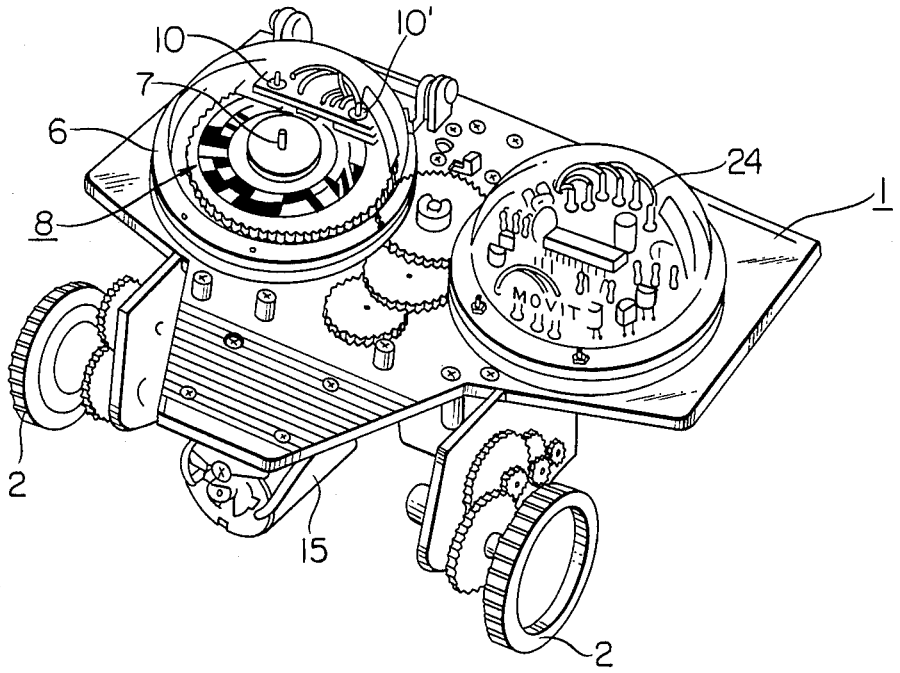
FIG. 6 shows a perspective view of an embodiment of the present invention.
Figure 7:
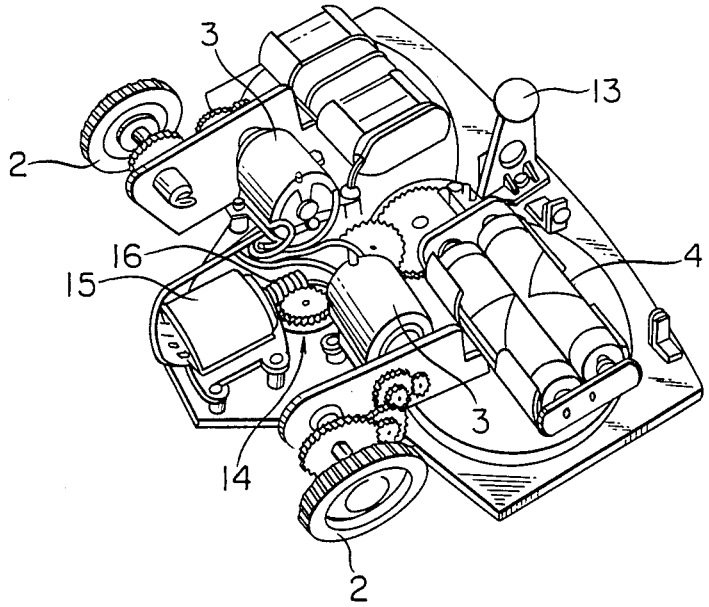
FIG. 7 shows a back view of FIG. 6.

FIGS. 6 and 7 show an embodiment of the present invention in which the rotary disc 8 is detachably mounted to the rotary shaft 7 which is rotated by a control driving motor 15. The control motor 15 and the driving motors 3 and 3' for driving the driving wheels 2 and 2' are mounted to the same body member 1. It is noted that the supporting member 13 includes a ball portion integrally formed with the body member 1.

Therefore, it is possible to change the moving pattern of this controlled-drive toy by changing the rotary disc 8 to one having different white and black data segments on data rings 9 and 9'.

Accordingly, the driving direction of the running car is simply controlled by white and black segments on the data rings of the rotary disc. Furthermore, it is very easy to change a running direction pattern by changing the rotary disc to one having different running patterns represented by white and black data segments at different locations and durations. Hence, the running car is automatically driven by the independent motors controlled by the rotary disc without requiring manual control.

I claim:

1. A controlled-drive toy comprising:

a body member providing a rotary shaft, batteries carried on said body member, a motor energized by said batteries for rotating said rotary shaft, a pair of driving wheels mounted on said body member independently driven by respective driving motors to move the toy, a rotary disc mounted to said rotary shaft and having a respective peripheral ring of light and dark data segments for each drive motor representing, by the relative location and duration of the light and dark segments, duration of rotation and non-rotation of each drive motor to produce, by the combined rotation and non-rotation of the drive motors for durations determined by data segments of the respective rings, a moving pattern for the toy, and sensor means mounted on said body member and including a pair of photosensors for sensing said data segments on said rings, respectively, and control means responsive to said sensor means for producing control signals to energize said driving motors from said batteries to move said toy in the moving pattern depending on the location and duration of said light and dark segments of the data segments.

2. A controlled-drive toy according to claim 1 wherein said rotary disc is detachably mounted to said rotary shaft.

* * * * *